United States Patent [19]

Burford

[11] 4,190,919

[45] Mar. 4, 1980

[54] SHOE CLEANING DEVICE

[76] Inventor: Roy T. Burford, 13715 Larkway, Sugar Land, Tex. 77478

[21] Appl. No.: 949,396

[22] Filed: Oct. 5, 1978

[51] Int. Cl.[2] ..... A47L 23/22

[52] U.S. Cl. ..... 15/4; 15/36; 15/97 A

[58] Field of Search ..... 15/4, 30, 34, 36, 97 A, 15/311

[56] References Cited

U.S. PATENT DOCUMENTS

| | | | |
|---|---|---|---|
| 826,806 | 7/1906 | Scoggins | 15/36 X |
| 3,144,675 | 8/1964 | Canaan | 15/36 X |

FOREIGN PATENT DOCUMENTS

| | | | |
|---|---|---|---|
| 20908 | 12/1904 | Sweden | 15/36 |

*Primary Examiner*—Edward L. Roberts

*Attorney, Agent, or Firm*—Clarence A. O'Brien; Harvey B. Jacobson

[57] ABSTRACT

The device has a motor with an elongated shaft rotated thereby. Mounted on the shaft is a flexible wire or nylon brush for cleaning leather soles of shoes. Also attached to the shaft is a rubber wheel for cleaning the rubber soles and heels of shoes. The motor, shaft, brush and rubber wheel are attached to a spring supported platform such that when pressure is applied to the rubber wheel or brush, the platform will move in a vertically downward direction thus maintaining the proper amount of pressure between the shoe and cleaning implement. The device is also provided with a coin operated switch controlling a timer for activating the motor.

8 Claims, 3 Drawing Figures

SHOE CLEANING DEVICE

BACKGROUND OF THE INVENTION

1. Field of the Invention

This invention relates to shoe cleaning devices especially such devices which are adapted for the cleaning of bowling shoes.

2. Description of the Prior Art

When engaged in the sport of bowling, the bowling shoes play a major roll in providing a smooth, fluid action of the bowler in releasing the ball. It is necessary to keep the soles of the bowling shoes clean as a bowler will usually slide to the foul line when releasing a ball at the end of his delivery motion. If particles of dirt or other forms of debris are imbedded in or stuck to the soles of the shoes, the shoes will have a tendency to stick to the floor thus causing a jerking action which may produce deleterious effects upon the bowler's delivery motion. In order to remove debris, the use of a motor driven shoe cleaning device is normally envisioned. Such a device, specifically designed for use with bowling shoes, is shown in U.S. Pat. No. 3,144,675, issued Aug. 18, 1964, to Canaan. The Canaan device shows a wire brush which is resiliently mounted and attached to a motor which causes rotation thereof. The wire brush of Canaan is useful in cleaning the leather soles of bowling shoes, however, such a brush is not as effective when used upon rubber bowling shoe soles. U.S. Pat. No. 3,060,475, issued Oct. 30, 1962, to Dufault, shows a shoe cleaning device having two laterally disposed brushes of a large diameter for cleaning the sides of shoes and a third brush attached coaxially to the laterally disposed brushes for cleaning the bottoms of shoes. The third brush has a diameter substantially less than the other two. The entire brush mechanism is turned by an electric motor and provides a mechanical boot and shoe cleaning device which can reach all of the parts of the boot or shoe.

Related patents also include U.S. Pat. No. 1,219,148, issued Mar. 13, 1917, to Pootmans, et al., U.S. Pat. No. 1,404,759, issued Jan. 31, 1922, to Hamilton, and U.S. Pat. No. 3,145,403, issued Aug. 25, 1964, to Allen. Each of these patents discloses a machine whose primary function is the polishing of the upper half of a shoe. Each patent discloses a brush or like instrument for applying wax to the shoe and a polishing instrument for buffing the shoe after the application of wax. These patents are only related to the present invention in that they disclose the use of a motor to rotate brushes which are used in some way to contact a portion of a shoe.

SUMMARY OF THE INVENTION

An object of the present invention is to provide a shoe cleaning device especially adapted for use with bowling shoes. The device includes one cleaning implement for the cleaning of rubber soled bowling shoes and a second cleaning implement for the cleaning of leather soled bowling shoes.

A further object of the present invention is to provide a shoe cleaning device wherein the cleaning implements are resiliently mounted in order to provide proper tension between the cleaning implement and the sole of the shoe being cleaned, thereby allowing for the maximum cleaning efficiency.

A still further object of the present invention is to provide a shoe cleaning device having the cleaning implements thereof attached to a common shaft of a motor for powering the implements. The motor, shaft and implements are resiliently mounted upon a common platform in order to reduce the components necessary in constructing the device, thereby reducing the overall cost of the device.

Yet another object of the present invention is to provide a shoe cleaning device which includes a coin operated timer control in order to adapt the device for commercial use.

A still further object of the present invention is to provide a shoe cleaning device having a housing, a portion of which is configured to serve as a rest against which the user of the device may lean in order to maintain his stability. In this manner, the shoes may be cleaned without the necessity of the user removing them from his feet.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
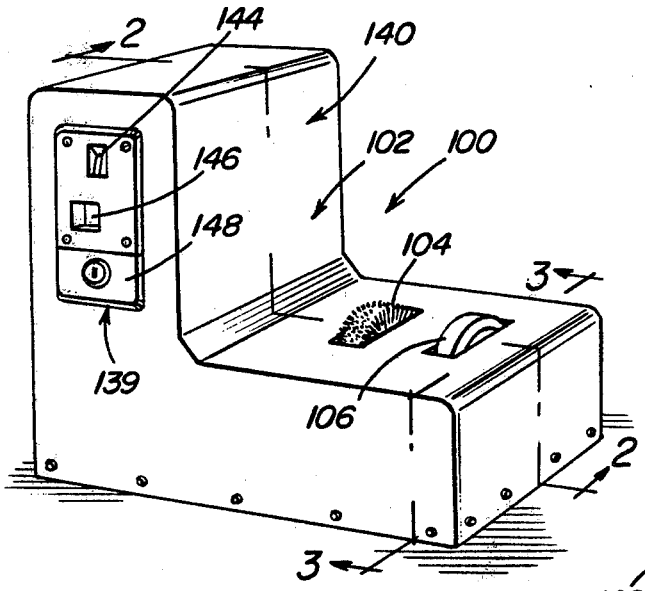
FIG. 1 is a perspective view of the shoe cleaning device.

Now with reference to the figures, the shoe cleaning device generally referred to by numeral 100 will be described in detail. Shoe cleaning device 100 comprises a housing 102 which has apertures disposed therein through which brush-type cleaning implement 104 and rubber wheel type cleaning implement 106 project. A coin acceptor 139 and a timer device 108 controls the simultaneous actuation of cleaning implements 104 and 106 based upon the money inserted therein.

Figure 2:
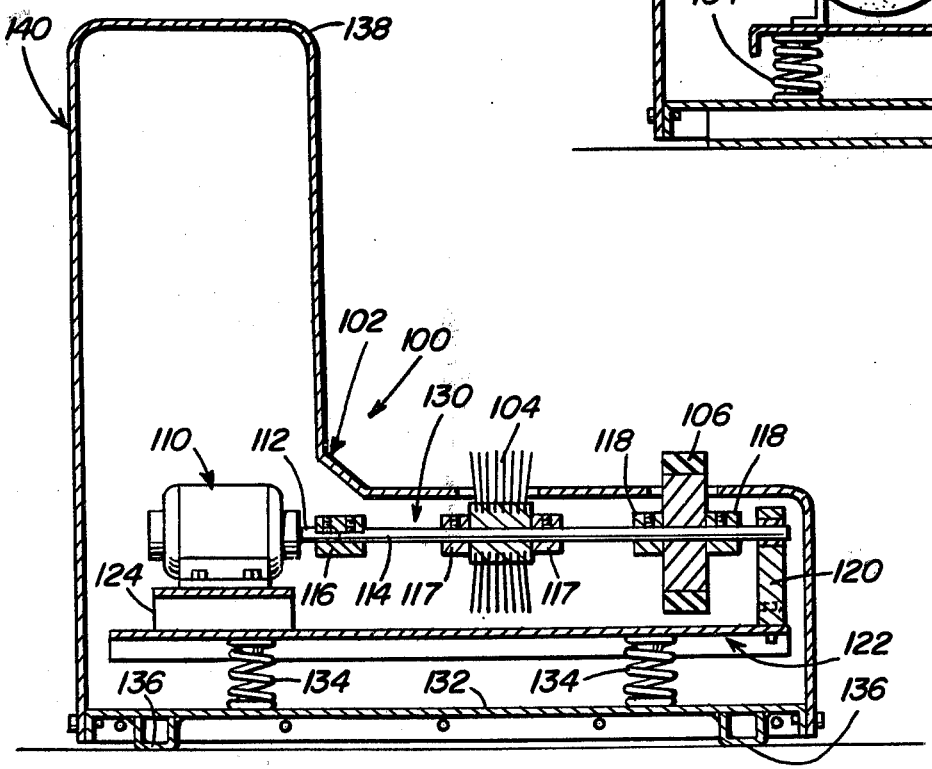
FIG. 2 is an elevational sectional view taken substantially along a plane passing through section line 2—2 of FIG. 1.

As seen with reference to FIG. 2, the drive motor 110 which may be any conventionally available universal type motor has a shaft 112 extending therefrom. Shaft 112 is attached to shaft extension 114 by the use of a coupling 116. Shaft extension 114 is preferably a $\frac{3}{8}$ or $\frac{1}{2}$ inch shaft which extends through the center of brush 104 and rubber wheel 106. Brush element 104 is attached to the shaft extension 114 through the use of collars 117 containing set screws therein. In a similar manner, collars 118 are used to secure wheel 106 to the shaft. The end of the shaft opposite motor 110 is supported and journaled by a pillow block bearing 120 which is itself securely fastened to base plate 122. Motor 110 is attached to a U-shaped mounting bracket 124 which is in turn welded or secured by any other suitable means to base plate 122. In this manner, the motor 110, shaft 112, shaft extension 114 with brush 104 and rubber wheel 106 riding thereon, pillow block bushing 120, mounting bracket 124 and base plate 122 form an integral structure, which will be generally referred to as cleaning unit 130.

Figure 3:
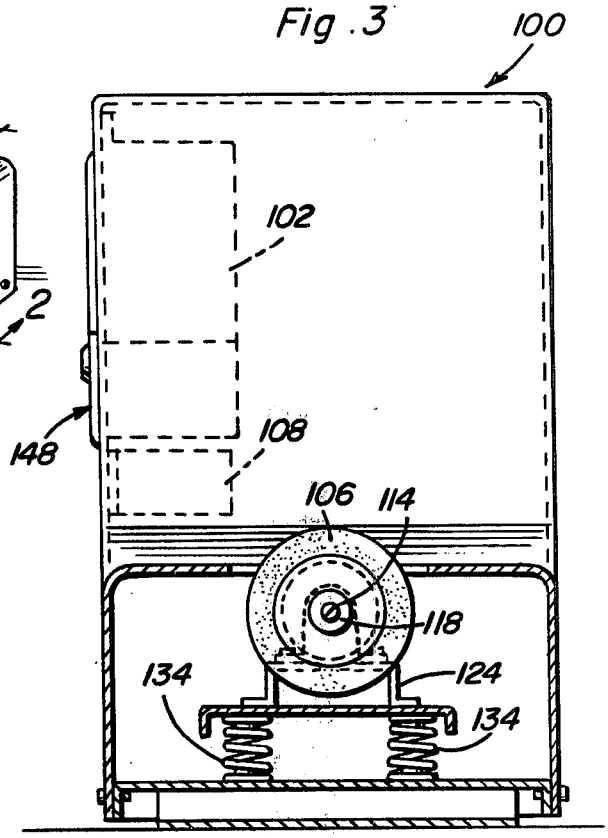
FIG. 3 is a front sectional view taken substantially along a plane passing through section line 3—3 of FIG. 1

Cleaning unit 130 is resiliently mounted upon housing base support 132 through the use of four coil springs 134, shown in FIGS. 2 and 3. Springs 134 may be connected to housing base 132 and base plate 122 by welding of the springs to each of these plates. Of course, any other suitable attachment device, such as a bolt and nut, would serve equally as well.

Welded to the bottom of housing base plate 132 are two elongated legs 136 upon which the entire housing 102 rests. Enclosing the working parts of the mechanism, except for portions of brush 104 and wheel 106, is housing cover plate 138 which includes vertically extended upright portion 140 which serves to lend support to the user of the device in that it affords a position against which the user may lean. It also serves to house coin acceptor mechanism 139 having coin acceptiong slot 144, coin return slot 146 and coin box 148. The coin acceptor may be a standardly available mechanism, such as the 2600 series of "Coin-Acceptors." The coin acceptor initiates operation of the variable timer 108 also housed within the upright portion of the device. Timer 108 controls the duratin of time of the operation of motor 110. The timer automatically stops operation at the end of a preset interval. Any commercially available timer will serve this purpose.

In operation, a user merely deposits a coin within slot 144 which initiates operation of the motor 110 which in turn rotates brush 104 and wheel 106. The user chooses the appropriate cleaning implement in accordance with the type of sole on his bowling shoe. He then rests his foot over the top of the cleaning implement rubbing it about the role to insure proper cleaning action. The resilient springs 134 give under the weight of the user insuring that proper frictional engagement between the cleaning implement and the sole of the shoe is maintained. Upon compression of the springs 134, of course, the cleaning unit 130 will be depressed slightly. It will be apparent that with the entire mechanism mounted upon springs, the use of flexible couplings of any sort between the motor and the cleaning implements is avoided, thereby increasing the life of the device.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In a shoe cleaning device comprising: first cleaning implement means including a brush for cleaning soles of shoes which soles have a first composition; second cleaning implement means comprising an elastomeric material for cleaning soles of shoes which soles have a second composition, said first and said second cleaning implement means being attached to a common shaft; drive means for activating said first and second cleaning implements, said drive means comprising a motor attached to said shaft for causing rotation thereof; and resilient mounting means for resiliently mounting said drive means, said first cleaning implement and said second cleaning implement.

2. The device of claim 1 including a variable timer for controlling the period of activation of said drive means.

3. The device of claim 2 and further including a coin operated switch means for initiating the activation of said variable timer means.

4. The device of claim 1 and further including a housing with a horizontally extended portion having apertures formed therein through which said first and second implements protrude, and a vertically extended portion for lending support to a user of the device.

5. The device of claim 1 wherein said motor, shaft, first cleaning implement and second cleaning implement are attached to a common base and wherein said mounting means comprises a plurality of springs attached to said base for providing vertical support thereto.

6. The device of claim 5 and further including a timer means for controlling the period of activation of said motor.

7. The device of claim 6 and further including a coin operated switch means for initiating the activation of said timer means.

8. The device of claim 7 wherein said springs are coil springs.

* * * * *